US010876727B1

(12) United States Patent
Xi

(10) Patent No.: US 10,876,727 B1
(45) Date of Patent: Dec. 29, 2020

(54) FENCE ASSEMBLY WITH LIGHTING SYSTEM

(71) Applicant: Guangdong YUHAO Electronics Co., Ltd., Dongguan (CN)

(72) Inventor: Jun Xi, Dongguan (CN)

(73) Assignee: GUANGDONG YUHAO ELECTRONICS CO., LTD., Dongguan (CN)

( * ) Notice: Subject to any disclaimer, the term of this patent is extended or adjusted under 35 U.S.C. 154(b) by 0 days.

(21) Appl. No.: 16/672,542

(22) Filed: Nov. 4, 2019

(30) Foreign Application Priority Data

Sep. 10, 2019 (CN) ..... 2019 2 1495625 U

(51) Int. Cl.

| | |
|---|---|
| ***F21V 33/00*** | (2006.01) |
| ***F21V 23/00*** | (2015.01) |
| ***F21V 23/06*** | (2006.01) |
| ***F21S 8/08*** | (2006.01) |
| ***F21Y 103/10*** | (2016.01) |
| ***F21W 131/10*** | (2006.01) |

(Continued)

(52) U.S. Cl.
CPC ..... *F21V 33/006* (2013.01); *F21S 8/08* (2013.01); *F21V 23/001* (2013.01); *F21V 23/06* (2013.01); *F21S 4/20* (2016.01); *F21S 8/081* (2013.01); *F21W 2131/10* (2013.01); *F21Y 2103/10* (2016.08); *F21Y 2115/10* (2016.08)

(58) Field of Classification Search
CPC ..... F21V 33/006; F21V 23/06; F21V 23/001; F21V 23/002; F21V 23/084; F21V 21/005; F21S 8/08; F21S 8/081; F21S 8/083; F21S 8/088; F21S 4/00; F21S 4/20; F21S 2/005; F21W 2131/109; F21W 2131/103; F21W 2131/10; E04H 17/08; E04H 17/22; E04H 2017/1486; E04H 2017/1452
See application file for complete search history.

(56) References Cited

U.S. PATENT DOCUMENTS 1,794,467 A * 3/1931 Lucas ..... F21V 33/006 362/152
3,684,882 A * 8/1972 Mininno ..... B44C 5/00 362/184

(Continued)

FOREIGN PATENT DOCUMENTS

| | | |
|---|---|---|
| CN | 202125826 U | 1/2012 |
| CN | 202511143 U | 10/2012 |
| CN | 103090301 A | 5/2013 |

*Primary Examiner* — Bryon T Gyllstrom
*Assistant Examiner* — James M Endo
(74) *Attorney, Agent, or Firm* — Hemisphere Law, PLLC; Zhigang Ma

(57) ABSTRACT

A fence assembly with a lighting system includes a hollow fixing base defining a plurality of first opening at an upper end thereof, a fence body, a plurality of light strips and electrical wires. The fence body includes a plurality of hollow second posts, and is removably connected to the fixing base and configured for sealing the plurality of first openings. Inner space of the fixing base communicates with inner space of the second posts. The plurality of light strips has a first end fixed in the fixing base and has the other part received in corresponding hollow second post. The electrical wires are accommodated within the inner space of the fixing base and used for electrically connecting with the first ends of the plurality of light strips.

7 Claims, 6 Drawing Sheets

(51) Int. Cl.

| | |
|---|---|
| ***F21Y 115/10*** | (2016.01) |
| *H01R 35/04* | (2006.01) |
| *E04H 17/14* | (2006.01) |
| *F21S 4/20* | (2016.01) |

(56) References Cited

U.S. PATENT DOCUMENTS 5,238,321 A * 8/1993 Jarjoura ..... A47B 57/44 256/65.03
5,249,970 A * 10/1993 Jennings ..... H01R 13/567 439/11
2003/0075712 A1* 4/2003 Lin ..... E04H 17/00 256/1
2004/0201992 A1* 10/2004 Dalton ..... F21S 9/02 362/276
2008/0084711 A1* 4/2008 Chen ..... F21V 21/0824 362/648
2008/0099751 A1 5/2008 Chen
2011/0062888 A1* 3/2011 Bondy ..... H05B 45/10 315/294
2011/0222287 A1* 9/2011 Lee ..... F21V 19/003 362/249.06
2013/0027914 A1* 1/2013 McCall ..... F21V 33/006 362/145
2013/0337662 A1* 12/2013 Lopez ..... F21V 23/06 439/11
2014/0036505 A1* 2/2014 Barton ..... F21S 2/00 362/249.06
2014/0144670 A1* 5/2014 Irons ..... H02G 11/00 174/86
2014/0293601 A1* 10/2014 Beausoleil ..... F21V 21/088 362/235
2016/0223152 A1* 8/2016 Baright ..... F21V 19/003
2017/0184284 A1* 6/2017 Van Winkle ..... F21V 23/04

* cited by examiner

FENCE ASSEMBLY WITH LIGHTING SYSTEM

BACKGROUND OF THE INVENTION

1. Field of the Invention

The present invention relates to a fence assembly, in particular to a fence assembly with a lighting system.

2. Description of Related Art

There are many types of fence assemblies on the market, such as iron fence assemblies, plastic fence assemblies, and wooden fence assemblies. In order to make the fence assembly more beautiful, and at the same time to create a special atmosphere at night, lighting decoration is usually arranged on the fence assembly. However, the existing fence assembly lighting decoration is basically hanging a string of lights or wrapping a string of lights on the outside of the fence assembly, lack of consistency between the lamp and the main body of the fence, resulting in poor viewing.

US Patent Application US 20080099751 A1 discloses a fence assembly with solar power light as shown in FIG. 9, the fence assembly includes a plurality of posts 1*d* and a plurality of transverse members 2*b*. A light string 29 is mounted to the bottom side of each of the posts 1*d*. A plurality of side wires extends parallelly from the light string 29 and is connected to a light bulb 24*b*. A plug 5 is connected to the light string 29 to directly supply electricity to drive the light bulbs 24*b* to emit light. However, all the side wires are exposed to the outdoors, exposed to the sunlight, wind and rain, and there is a risk of electrical wire aging and leakage after long-term use.

BRIEF DESCRIPTION OF THE SEVERAL VIEWS OF THE DRAWING(S)

The foregoing and other exemplary purposes, aspects and advantages of the present invention will be better understood in principle from the following detailed description of one or more exemplary embodiments of the invention with reference to the drawings, in which.

DETAILED DESCRIPTION OF THE INVENTION

The invention will now be described in detail through several embodiments with reference to the accompanying drawings.

Please refer to FIG. 1 to FIG. 5, according to a first embodiment of the present invention, a fence assembly 100 with a lighting system 10 mainly includes a hollow fixing base 20, a fence body 30 and the lighting system 10.

Figure 5:
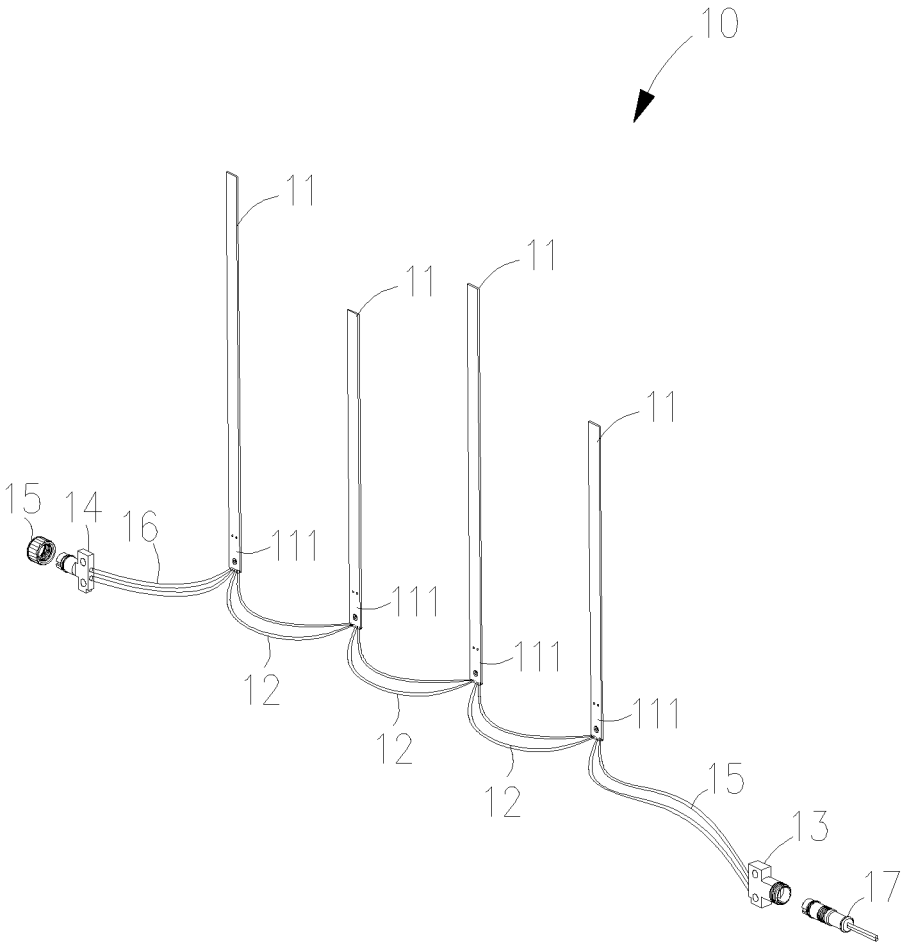
FIG. 5 is a perspective view of the lighting system in accordance with the first embodiment.

As shown in FIG. 5, the lighting system 10 mainly includes several (2 to 10 for example) light strips 11 with a first end 111 received in the fixing base and with the other part received in the fence body 30, electrical wires 12 used for connecting adjacent light strips 11 with each other, and a male electrical connector 13 and a female electrical connector 14 respectively connected with two light strips 11 which are located at two sides of the lighting system 10. In detail, the female electrical connector 13 is connected to a rightmost light strip 11 via electrical wires 15 as shown in FIG. 5, and the male electrical connector 14 is connected to a leftmost light strip 11 via electrical wires 16 as shown in FIG. 5. The female electrical connector 13 may electrically connected to an external power supply via a male connector 17, or maybe connected to the male electrical connector 14 of another fence assembly so as to electrically connected with the another fence assembly. The external power supply may be such as a commercial power supply or a battery or a solar panel to supply electricity to the fence assembly. The male electrical connector 14 may be covered by a protection cap 15 when there is no need to expand another fence assembly, or maybe connected to the male electrical connector 13 of another fence assembly so as to electrically connected with the another fence assembly. Each light strip 11 may include a flexible or rigid circuit board and several LED chips connected to one or both sides of the circuit board. In the embodiment, the light strips 11 include rigid circuit board, so the light strips can stand without contacting an inner surface of the fence body.

The hollow fixing base 20 is used for accommodating the first ends 111 of the light strips 11, the electrical wires 12 and at least a part of the electrical wires 15, 16. Therefore, several first openings are defined at an upper end of the fixing base 20. In the embodiment, the fixing base 20 mainly includes several hollow first posts 21 each defining a first opening 211 at its upper end 212, and several hollow first transverse members 22 each of which being connected between two adjacent first posts 21. Inner space of the first transverse members 22 should communicate with inner space of the first posts 21. The first ends of the light strips 11 are inserted in the first openings 211 and are fixed in the first posts 21. Each electrical wire 12 is accommodated within the inner space of a first transverse member 22 and electrically connects with two connecting pads of two corresponding first ends of two adjacent light strips 11. The fixing base 20 is made of insulation materials, such as macromolecules and is substantially opaque. For ease of assembly, the fixing base 20 is formed as two separable parts 201, 202 that are joined by an interference fit between holes and cylinders or protrusions and depressions.

Figure 1:
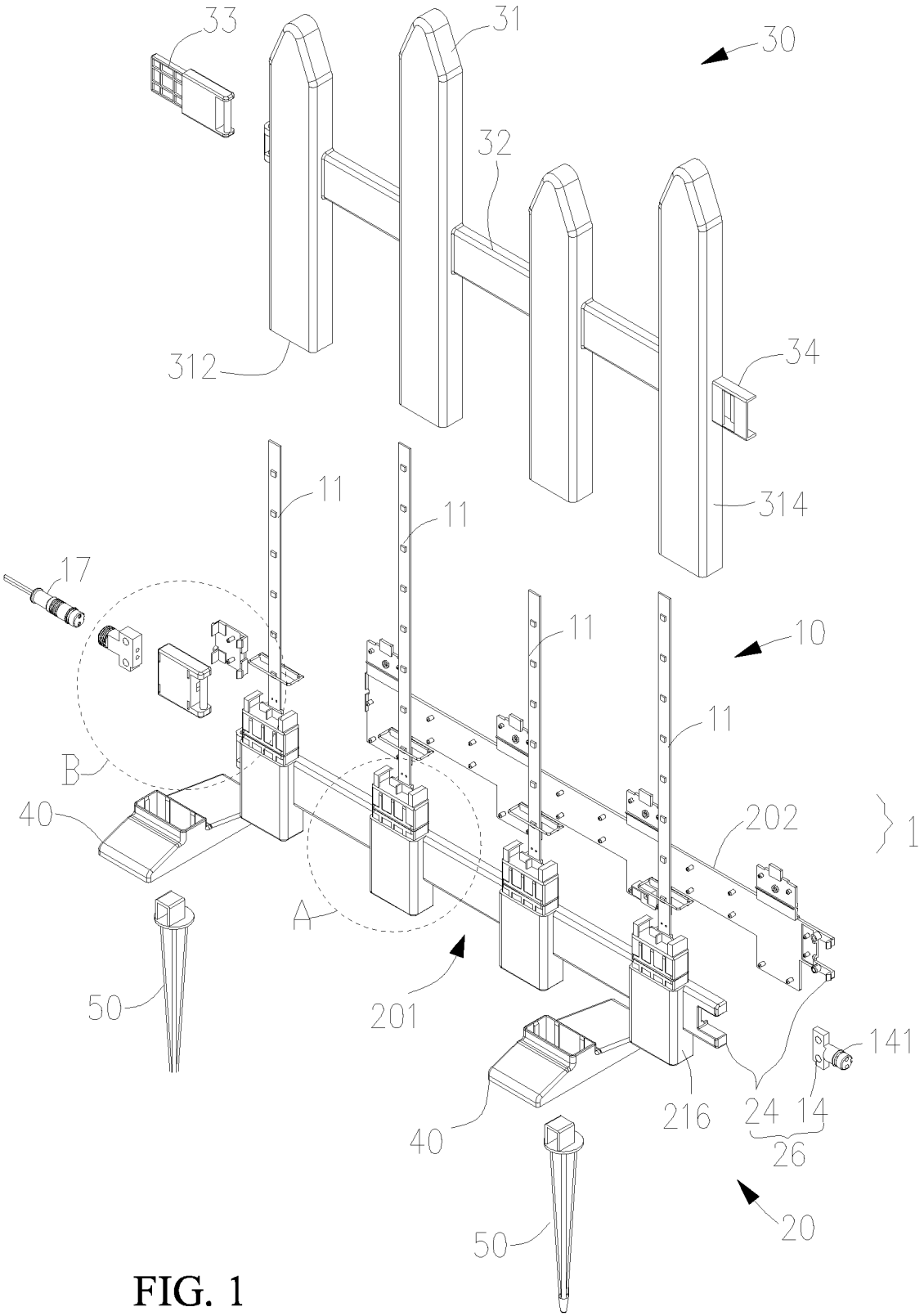
FIG. 1 is an exploded view of a fence assembly with a lighting system in accordance with a first embodiment of the present invention.
Figure 2:
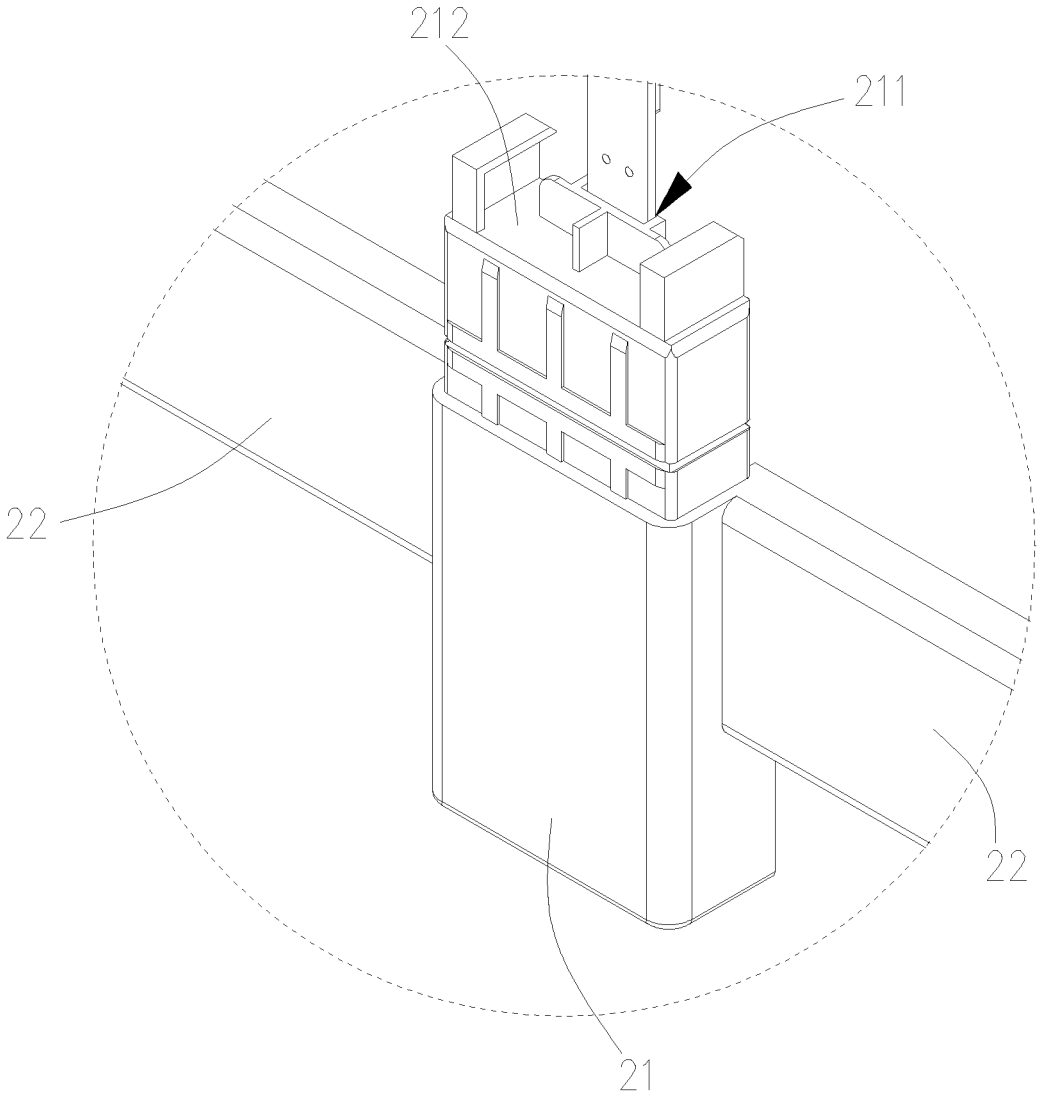
FIG. 2 is an enlarged view of a part A of the fence assembly of FIG. 1.
Figure 3:
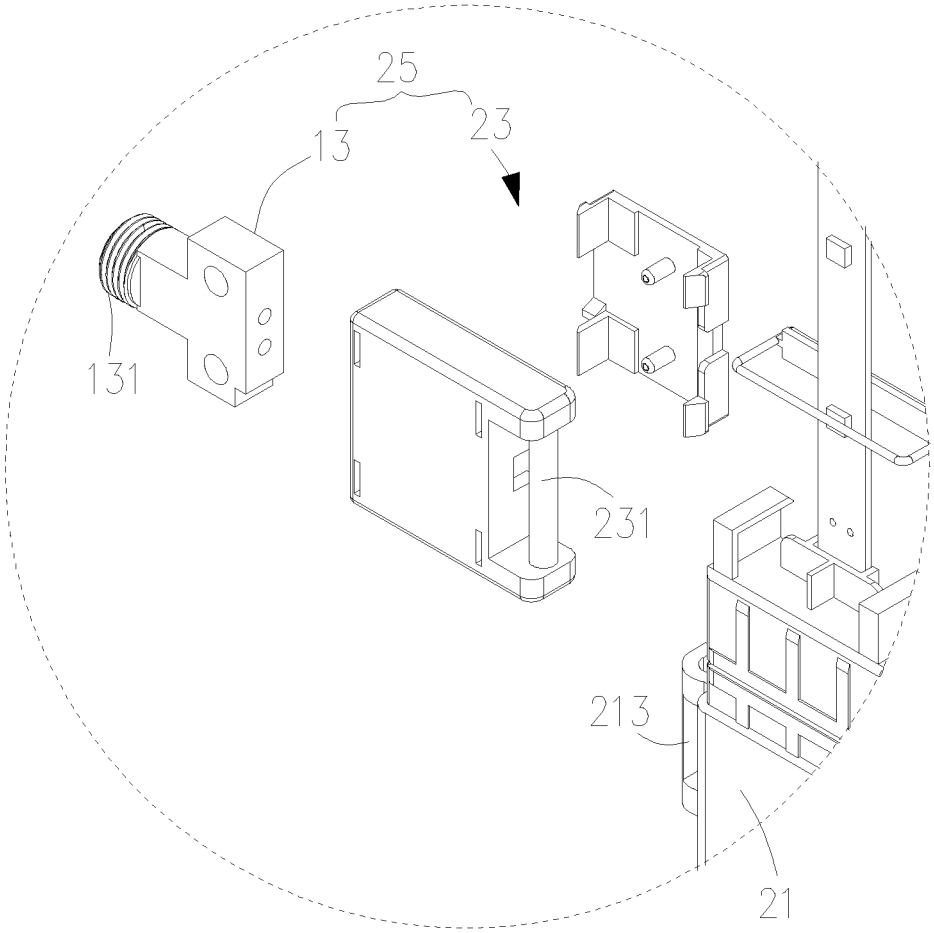
FIG. 3 is an enlarged view of a part B of the fence assembly of FIG. 1.
Figure 4:
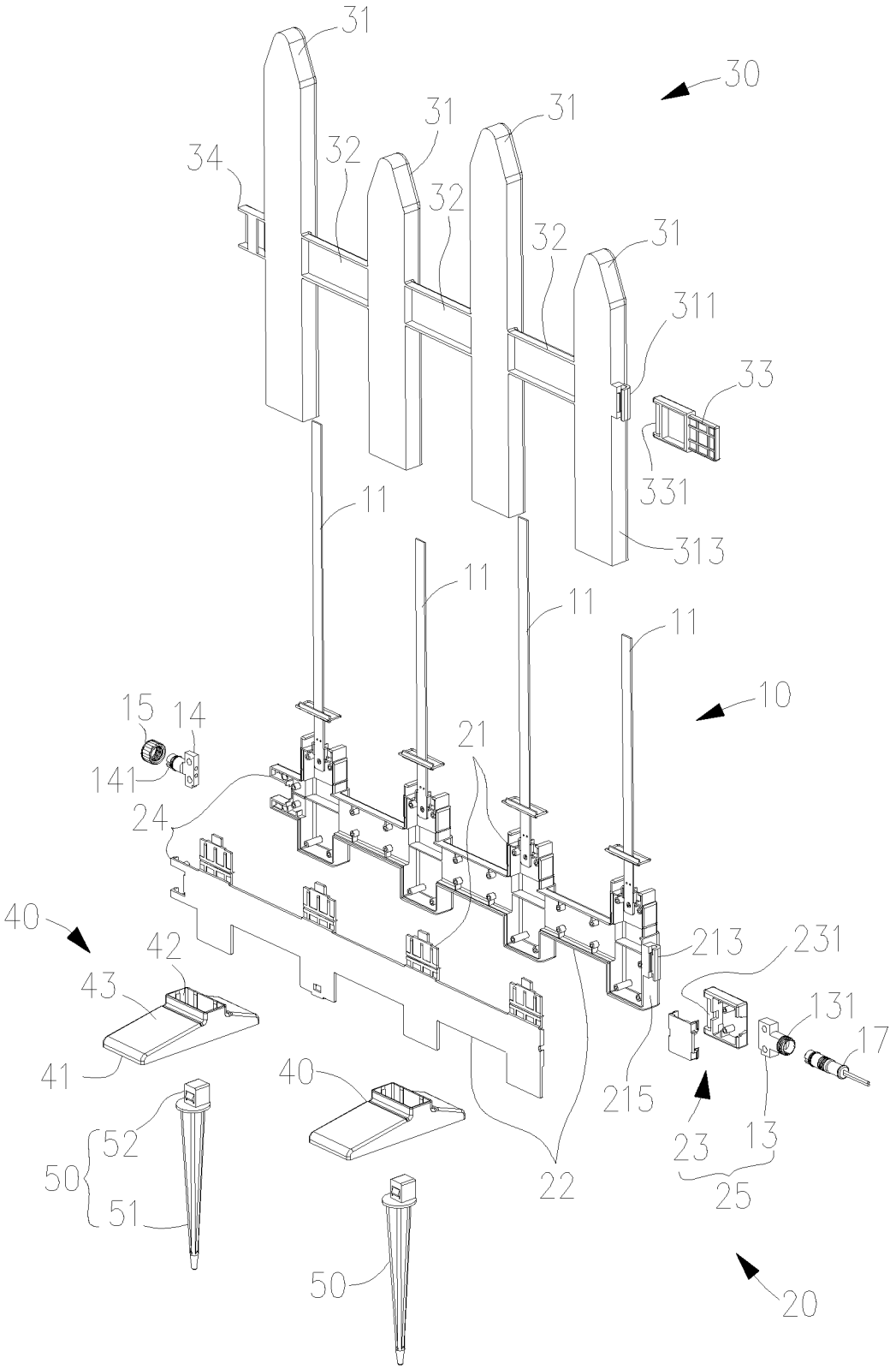
FIG. 4 is another exploded view of the fence assembly.

One side end of the fixing base 20, a side surface 215 of a rightmost first post 21 in the embodiment as shown in FIG. 4, is provided with a male housing 23 for receiving the male electrical connector 13, and the other side end of the fixing base 20, a side surface 216 of a left most first post 21 in the embodiment as shown in FIG. 4, is provided with a female housing 24 for receiving the female electrical connector 14. The male housing 23 and the male electrical connector 13 form a male plug 25 with a port 131 of the male electrical connector 13 protrudes out of the male housing 23. The female housing 24 and the female electrical connector 14 form a female plug 26 with a port 141 of the female electrical connector 14 protrudes out of the female housing 24. The male and the female plugs are capable of connecting with each other. At least one the male and the female plugs is rotatably connected with the side end of the fixing base 20, so that when two or two more fence assemblies are connected via the male and the female plugs, an angle can be formed between two adjacent fence assemblies. In the embodiment, the male housing 23 is rotatably connected with the rightmost first post 21 as shown in FIG. 4. A hook 213 protrudes out from a side surface of the rightmost first post 21, and the male housing 23 includes a rod 231 inserting in the hook 213 and hooked by the hook 213. While the female housing 24 extends integrated from a side surface of the leftmost first post 21. Similar to the fixing base 20, the male and the female housings 23, 24 are respectively formed as two separable parts that are joined by an interference fit between holes and cylinders or protrusions and depressions.

The fence body 30 includes several hollow second posts 31 and several second transverse members 32 each of which being connected between two adjacent second posts 31. Both the second posts 31 and the second transverse members 32 or the second posts 31 are made of an electrically insulated light transmitting material, that is a semi-transparent material or a transparent material, such as PP (polypropylene). All the hollow second posts 31 are removably connected to the fixing base 20 and used for sealing the first openings 211 of the first posts 21. Inner space of the fixing base 20 communicates with inner space of the second posts 31. In the embodiment, the upper end 212 of each first post 21 is inserted in a lower end 312 of a corresponding second post 31, therefore rain can not flow into the fixing base 20. Second ends of the light strips 11 extend in the hollow second posts 31, that is the rest of the light strips 11 except the first ends are received in the second posts 31.

Furthermore, a first connecting piece 33 extends outwardly from a side end 313 of the fence body 30 and a second connecting piece 34 extends outwardly from the other side end 314 of the fence body 30, and the first connecting piece 33 and the second connecting piece 34 are engageable to connect adjacent fence assemblies. Preferably, least one of the first and the second connecting pieces 33, 34 is rotatably connected to the fence body 30. Similar to the male and the female plugs of the fixing base 20, in the embodiment, the first connecting piece 33 which is connected to a side surface 313 of a rightmost second post 31 in FIG. 4 is rotatable. A hook 311 protrudes out from a side surface 313 of the rightmost second post 31, and the first connecting piece 33 includes a rod 331 inserting in the hook 311 and hooked by the hook 311. While the second connecting piece 34 integratedly extends from a side surface 314 of the leftmost second post 31.

The fence assembly further includes at least two base supports 40 each having a flat bottom surface 41 and an upper protrude 42 defining a receiving groove 43 used for receiving a lower end of one of the first posts 21. By utilizing the base supports 40, the fence assembly can stably stand on a hard flat ground such as a flat concrete floor. The Fence assembly may further include at least two plungers 50. A lower end 51 of each plunger 50 is formed in a tapered shape, and an upper end of each plunger 50 is provided with a plug 52, understandably the flat bottom surface 41 of each base supports defines a groove (not shown) for receiving the plug 52 of the plunger 50. By further utilizing the plungers 50, the fence assembly can be securely place on a soft or uneven ground such as lawn or mud ground. The base supports 40 and the plungers 50 can meet the requirements of setting the fence assembly on different grounds, and improve the applicability of the fence assembly.

The fence body 30 of the fence assembly of the present invention is made of a light transmitting material, and the light strips 11 are disposed in the fence body 30, and the light is soft after lighting, and has strong ornamental and practicality. All the electrical wires connecting between the light strips 11, the male and the female plugs are safely received in the fixing base 20. A life of the wires is ensured. Two or two more fence assemblies can be physically and electrically connected together through the male and the female plugs 13, 14 and the first and the second connecting pieces 33, 34 to form a larger fence according to the actual required length, and only one external power supply is needed. The assembly and disassembly are very easy and convenient. Angle(s) between the fence assemblies is conveniently adjusted. The first and the second connecting pieces 33, 34 are provided on both sides of the fence body 30, which can further improve the stability of the connection. It is equipped with base supports 40 and the plungers 50, which are suitable for hard ground and soft ground respectively, thereby improving the applicability of the fence assembly.

Figure 6:
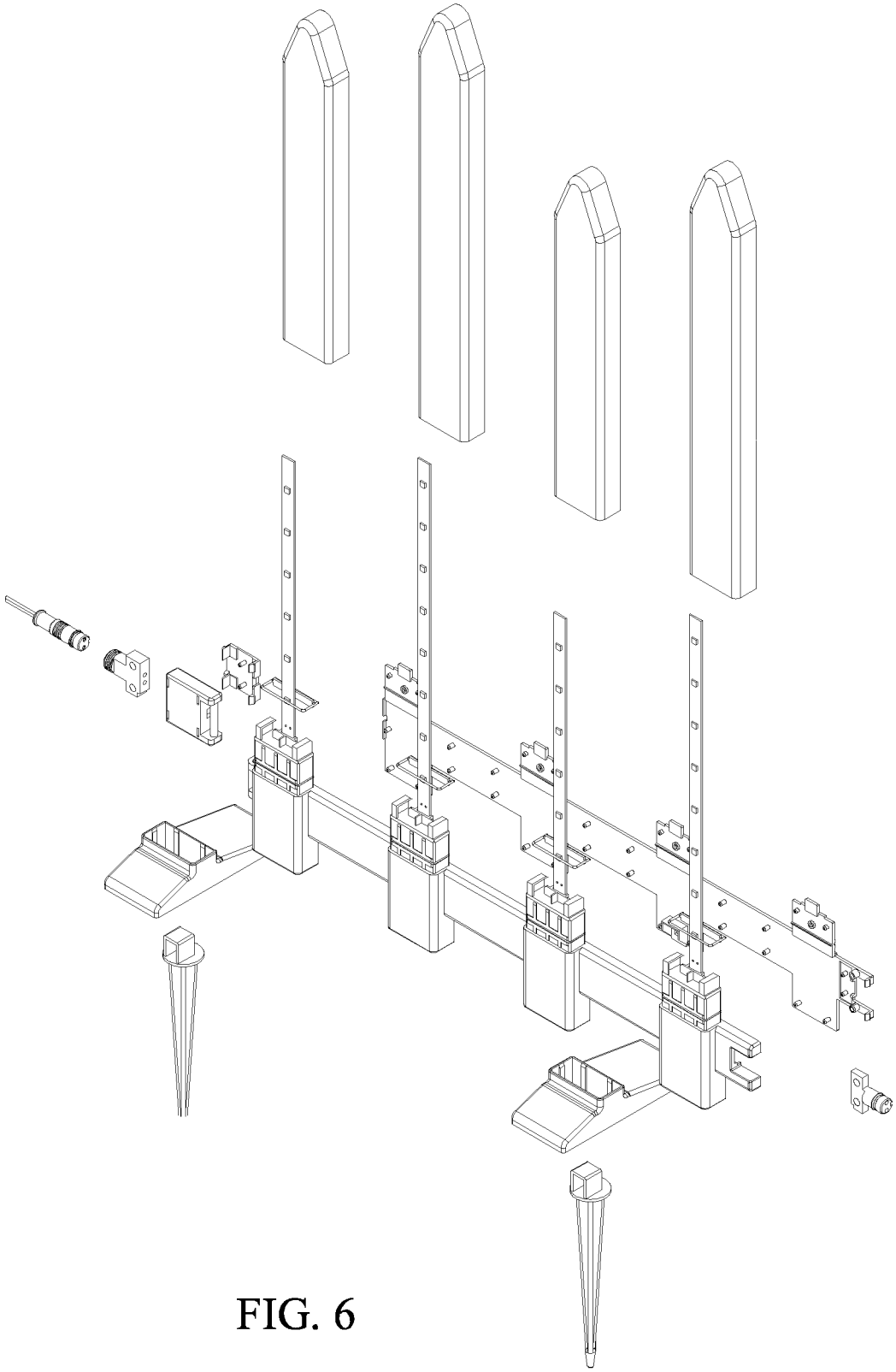
FIG. 6 is an exploded view of a fence assembly with a lighting system in accordance with a second embodiment of the present invention.

In a second embodiment as shown in FIG. 6, second transverse members connected between adjacent second posts and the first and the second connecting pieces may be omitted, other components may be the same as those in the first embodiment.

Understandably, in other embodiments, the light strips can be replaced by string lights or light bars. The fixing base may also be made of light transmitting material.

In other embodiments, the base supports 40 and the plungers 50 may be omitted, or only the plungers 50 may be omitted.

In other embodiments, the fixing base may be substantially cuboid, several protrudes extend upwardly from an upper surface of the cuboid to form the first posts, and the first openings are defined in upper surfaces of the protrudes.

While the invention has been described in terms of several exemplary embodiments, those skilled on the art will recognize that the invention can be practiced with modification within the spirit and scope of the appended claims. In addition, it is noted that, the Applicant's intent is to encompass equivalents of all claim elements, even if amended later during prosecution.

What is claimed is:

1. A fence assembly with a lighting system, comprising:

a hollow fixing base comprising:

a plurality of hollow first posts each defining a first opening at its upper end; and a plurality of hollow first transverse members, each of which being connected between two adjacent first posts, an inner space of the first transverse members communicating with an inner space of the first posts;

a fence body comprising a plurality of hollow second posts, the upper end of each first post being inserted in a lower end of a corresponding second post, an inner space of the fixing base communicating with an inner space of the second posts;

a plurality of light strips with a first end fixed in the fixing base and the other part received in corresponding hollow second post; and electrical wires being accommodated within the inner space of the fixing base and configured for electrically connecting with the first ends of the plurality of light strips;

wherein one side end of the fixing base is provided with a male plug, and the other side end of the fixing base is provided with a female plug;

wherein the male plug comprises a male housing and a male electrical connector disposed in the male housing, a port of the male electrical connector protrudes out of the male housing and electrically connected to one of the plurality of light strips via the electrical wires, the male housing is rotatably connected to the side end of the fixing base;

wherein the female plug comprises a female housing and a female electrical connector disposed in the female housing, a port of the female electrical connector protrudes out of the female housing and electrically connected to one of the plurality of light strips via the electrical wires, the female housing is non-rotatably connected to the side end of the fixing base.

2. The fence assembly with the lighting system according to claim 1, further comprising at least two base supports each having a flat bottom surface and an upper protrude defining a receiving groove configured for receiving a lower end of a first post.

3. The fence assembly with the lighting system according to claim 2, further comprising at least two plungers, a lower end of each plunger is formed in a tapered shape, and an upper end of each plunger is provided with a plug which is capable of connecting with the flat bottom surface of each base supports.

4. The fence assembly with the lighting system according to claim 1, wherein the fence body further comprises a plurality of second transverse members, each of which being connected between two adjacent second posts.

5. The fence assembly with the lighting system according to claim 4, wherein a first connecting piece extends outwardly from a side end of the fence body and a second connecting piece extends outwardly from the other side end of the fence body, and the first connecting piece and the second connecting piece are engageable.

6. The fence assembly with the lighting system of claim 5, wherein at least one of the first and the second connecting pieces is rotatably connected to the fence body.

7. The fence assembly with the lighting system according to claim 1, wherein the fence body is made of an electrically insulated semi-transparent material.

* * * * *